United States Patent [19]

Rampignon et al.

[11] Patent Number: 4,469,972

[45] Date of Patent: Sep. 4, 1984

[54] COMMUTATOR FOR A MINIATURE ELECTRIC MOTOR

[75] Inventors: Marc Rampignon, Villemomble; Claude Chevance, Savigny sur Orge, both of France

[73] Assignee: Compagnie Industrielle des Mecanismes, Levallois Perret, France

[21] Appl. No.: 477,110

[22] Filed: Mar. 21, 1983

[30] Foreign Application Priority Data

Mar. 23, 1982 [FR] France ..... 82 04898

[51] Int. Cl.[3] ..... H02K 13/00

[52] U.S. Cl. ..... 310/233; 310/42

[58] Field of Search ..... 310/219, 231, 233, 234, 310/235, 236, 237, 232, 42, 43; 29/597

[56] References Cited

U.S. PATENT DOCUMENTS

| | | | |
|---|---|---|---|
| 2,322,020 | 6/1943 | Hemphill | 310/235 |
| 2,639,396 | 5/1953 | Harry | 310/235 |
| 4,188,713 | 2/1980 | Kawano | 310/236 |
| 4,322,650 | 3/1982 | Mabuchi | 310/233 |

FOREIGN PATENT DOCUMENTS

| | | | |
|---|---|---|---|
| 1228890 | 9/1960 | France | 310/235 |
| 0048006 | 6/1980 | Japan | 310/236 |
| 2060274 | 4/1981 | United Kingdom | 310/233 |

*Primary Examiner*—R. Skudy

[57] ABSTRACT

The commutator comprises three conductive sectors 2 which are maintained against a cylindrical insulating core 4 by an insulating ring 3. Cut out from the rear end portion of each sector is a terminal 11 which defines two tabs 12 projecting axially at the rear end of the sector. Each pair of tabs straddles a parallelepipedic projection 5 of the core 4. The three sectors are maintained radially and axially in position by the ring 3 which comprises an annular portion 15 from which extend three claws 16 in the longitudinal direction, the claws being clipped behind a flange 6 which projects from the core. In this way, it is possible to mould the core and the ring 3 from a thermosetting material and to improve the maintenance of the sectors 2.

6 Claims, 7 Drawing Figures

COMMUTATOR FOR A MINIATURE ELECTRIC MOTOR

DESCRIPTION

The present invention relates to a commutator for a miniature electric motor of the type comprising: an insulating core for mounting on the shaft of the rotor of the motor and having a cylindrical outer surface; a plurality of conductive sectors applied against said surface, each sector being provided at the rear end thereof with a terminal which projects radially and is cut out from a part of the width of the sector and defines at least one tab which projects axially with respect to the base of the terminal, said tab circumferentially positioning the sector; and a ring for retaining the sectors against the core.

Owing to the increasing miniaturization of electric motors, attemps have been made to find means for fixing the conductive sectors on the core in a manner more appropriate than by the conventional moulding assembly employed for commutators of larger size, and this has resulted in commutators of the aforementioned type employed for example in automobiles.

In the known commutators of this type, the axial tabs of the conductive sectors are inserted in arcuate slots provided at the base of a flange which projects from the rear of the commutator. These slots are very shallow and correspond to punches of the moulding die which are of very small section and consequently fragile. Moreover, the shape of the core is too complicated to permit the use of thermosetting plastics material, while these materials would be highly desirable to ensure the stability of the core when producing the connections by the simple insertion of the wires of the armature in the hooks of the terminals of the sectors and followed by a radial "hot pressing" thereof.

An object of the invention is to provide a commutator of the same type which is easier to produce.

The invention therefore provides a commutator of the aforementioned type, wherein the tabs are interposed between projections which are circumferentially spaced apart and project from the cylindrical surface of the core.

In particular, in order to effect the hot pressing operation more conveniently, each projection may have a parallelepipedic shape and each terminal may terminate in a portion in the shape of a hook located in the region of one of the projections.

In an embodiment which ensures high reliability as concerns the retention of the sectors against the core without increasing the overall size of the commutator, the core has at the rear of the projections a flange of smaller height which is continuous or discontinuous and behind which claws of the retaining ring hook, which claws extend between the projections.

In this case, a particularly firm retention of the sectors is achieved when the height of the flange is less than the thickness of the sectors and the claws are applied resiliently against the tabs of the sectors.

The invention is described hereinafter in more detail with reference to the accompanying drawings which show only one embodiment thereof. In the drawings.

Figure 1:
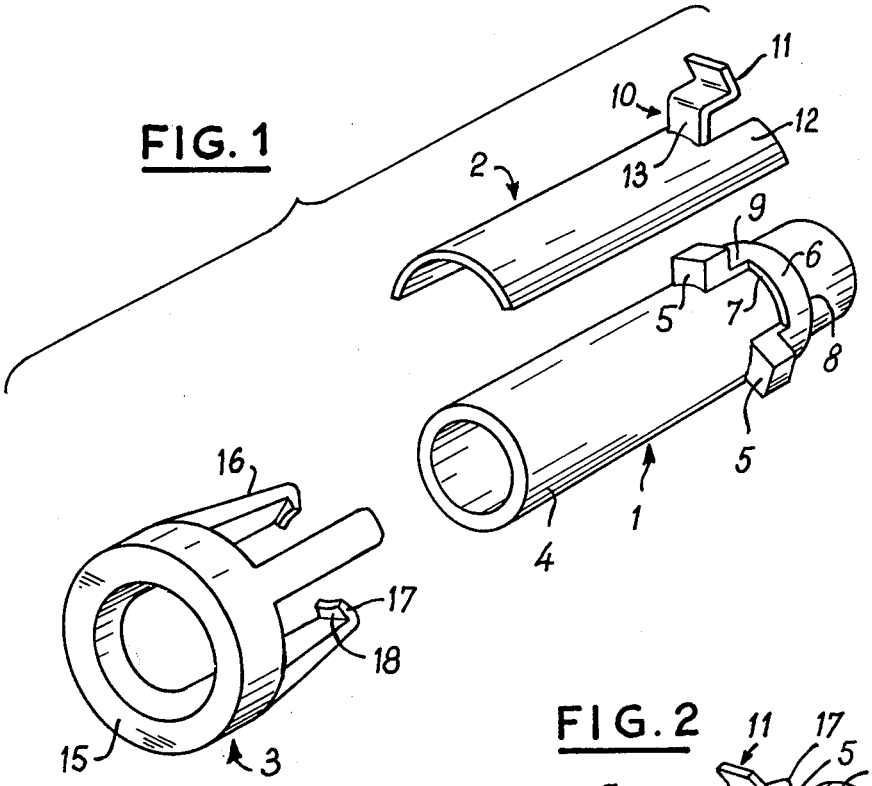
FIG. 1 is a partial exploded perspective view of a commutator according to the invention.
Figure 2:
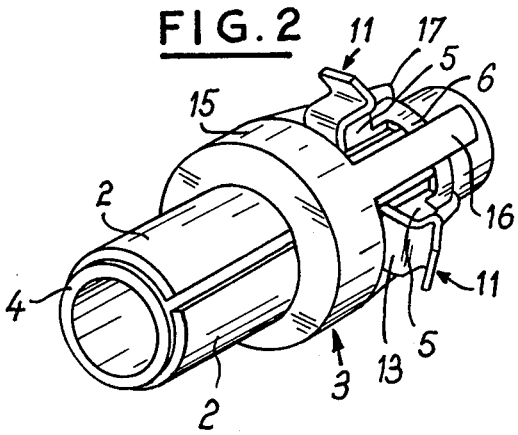
FIG. 2 is a perspective view of the assembled commutator.

The commutator shown in FIGS. 1 to 6, which has an overall length of less than 1 cm, comprises five parts: a central core 1, adapted to be mounted with a drive fit on an armature shaft (not shown) of an electric motor, three conductive sectors 2 (only one of which is shown in FIG. 1), and a gripping retaining ring 3.

The core 1 has a cylindrical tubular body 4 of insulating material, preferably of a thermosetting plastics material, at the end (rear end, ie. the end adjacent to the armature) of which radially project three parallelepipedic projections 5 which are circumferentially spaced 120° apart. At a small distance to the rear of the projections 5, a continuous flange 6 also projects from the core and has a distinctly smaller height and is defined by two planar surfaces 7 and 8. The front surface 7 is connected to the rear surface of each projection 5 by a longitudinally extending strip 9 which has the same width as the projection and the same height as the flange 6 so as to facilitate stripping the core from the die.

Figure 6:
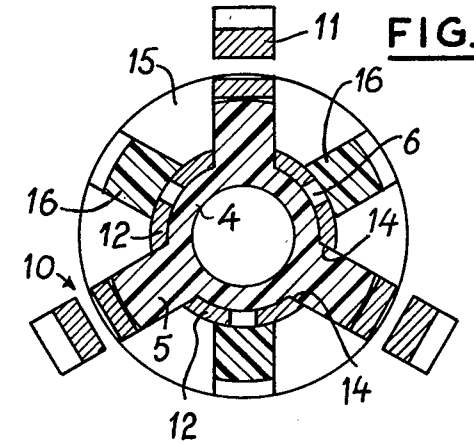
FIG. 6 is a sectional view taken along line 6—6 of FIG. 4.

Each conductive sector 2 has the general shape of a cylindrical sector which has an angular extent of a little less than 120° and corresponds to the outer surface of the body 4 of the core. Cut out from the rear end portion of the sector in the central part and having a width which is about one third of the width of the sector, is a strip portion which initially projects axially from the sector and is folded outwardly at a right angle and then rearwardly at a right angle and then forwardly at about 45° so as to form a connection terminal 10 which terminates in a hook 11. On each side thereof, the terminal 10 defines a tab 12 which projects axially from the radial part 13 of the terminal to a position slightly beyond the hook 11. The distance between the confronting parallel surfaces 14 of two tabs 12 is equal to the width of the projections 5 (FIG. 6).

The retaining ring 3 is of insulating material and, as the core 1, it is preferably moulded from a thermosetting plastics material. It comprises a ring 15 having a rectangular cross-sectional shape, from the rear surface of which ring project three longitudinally extending claws 16.

As can be seen better in FIGS. 3 to 6, the outside diameter of the ring 15 is roughly equal to the outside diameter of the radial part 13 of the terminals and its inside diameter is slightly less than the inside diameter of the body 4 plus twice the thickness of a sector 2.

Internally, each claw 16 extends the inner surface of the the ring 15 in a direction parallel to the axis of the latter. Externally, the claw extends from the outer surface of the ring 15 and is mildly convergent towards the axis of the ring 15. The claw has at its end a nose portion 17 which defines a radially extending hooking shoulder 18 and a rear ramp 19. The circumferential width of the claws 16 is distinctly less than the space between the projections 5.

In order to assemble the commutator, the sectors 2 are applied against the body 4 with a small mutual circumferential spacing therebetween (FIG. 6), the projections 5 being in confronting relation to the terminals 10, and the sectors are shifted rearwardly.

The projections 5 fit themselves exactly between the pairs of associated tabs 12 and the radial parts 13 apply themselves against the front surface of these projections, while the hooks 11 bear against the radially exterior planar surface of the projections 5.

The ring 3 is then fitted with a drive fit on the three sectors 2 until it abuts against the three radial parts 13 of the terminals. In doing so, the nose portions 17 slide along the sectors 2, pass between the projections 5, travel beyond the flange 6 and clip themselves behind the latter, their surfaces 18 being hooked against the rear surface 8 of the flange. This is made possible by the radial resilience of the claws 16 and by the ramps 19 of the nose portions 17.

Figure 4:
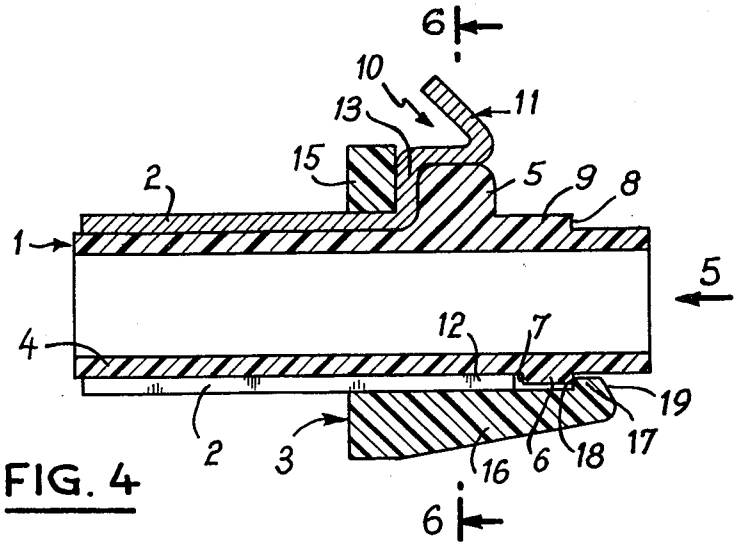
FIG. 4 is a sectional view taken along line 4—4 of FIG. 3.
Figure 3:
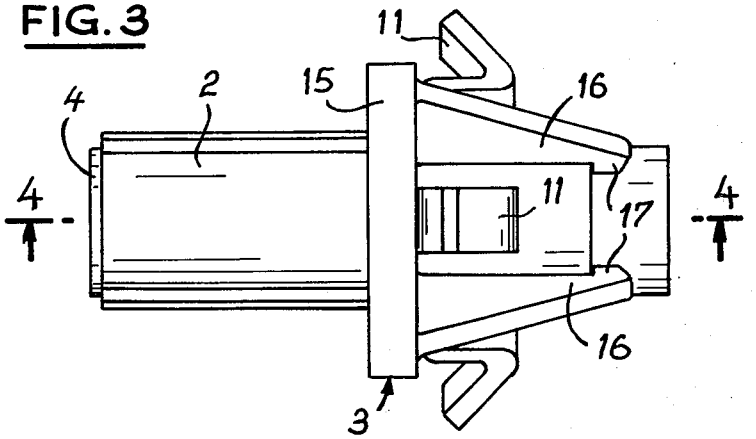
FIG. 3 is a plan view of the commutator.
Figure 5:
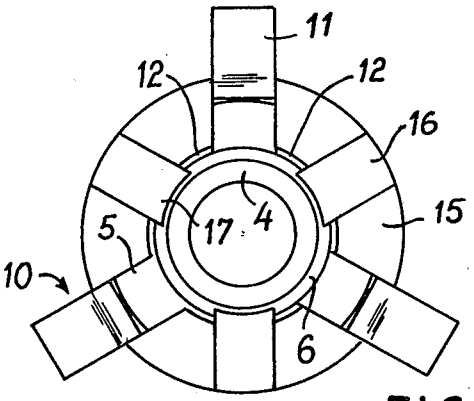
FIG. 5 is an end elevational view in the direction of arrow 5 in FIG. 4.

When the commutator is assembled in this way, the hooking of the nose portions 17 guarantees that the ring 15 exerts a permanent axial thrust which applies the parts 13 of the terminals against the projections 5. Further, as can be seen in FIG. 4, the height of the flange 6 is less than the thickness of the sectors; consequently, the claws 16 radially press the tabs 12 against the body 4 throughout the length of these tabs, each claw 16 overlapping two tabs 12 pertaining to two adjacent sectors. In this way, an excellent positioning and an excellent positive maintenance of the sectors 2 are achieved in all directions irrespective of the speed of rotation of the motor.

Further, the simple shape of the core and of the ring 3 enables them to be produced without difficulty from a thermosetting plastics material. Consequently, when the connection wires (not shown) are inserted in the hooks 11 and the latter are then radially compressed by a hot pressing operation, these hooks are provided by the projections 5 with a large support surface which does not deform under the effect of the heat. Likewise, the ring 3, whose annular portion 15 is in the neighbourhood of the heated region, is not deformed in the course of this operation and consequently continues to perform its maintaining function perfectly.

Figure 7:
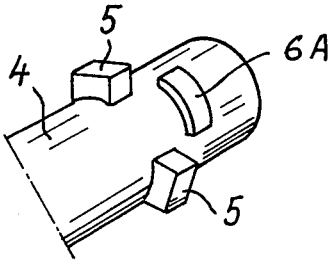
FIG. 7 is a detail view of the core of a modification of the commutator according to the invention.

By way of a modification, as shown in FIG. 7, the flange 6 and the strip portions 9 may be replaced by three segments 6A of a flange which are inserted, when viewed from the end of the core, between the projections 5. Indeed, this in no way changes the hooking of the claws 16 or the conditions of the stripping of the core 1 from the die.

Having now described our invention what we claim as new and desire to secure by Letters Patent is:

1. In a commutator for a miniature electric motor comprising: an insulating core for mounting on a shaft of a rotor of the motor and having a cylindrical outer surface; a plurality of conductive sectors applied against a portion of said surface, each sector having at a rear end thereof a terminal which projects radially of the core and is cut out from a portion of the width of the sector and defines at least one tab which projects from a base of the terminal axially of the core, said tab ensuring the circumferential positioning of the sector; and a ring structure for retaining the sectors against the core; the improvement comprising projections which are circumferentially spaced apart and project from the cylindrical surface of the core, said tabs being inserted between said projections, said ring structure having claws and said core having, on a side of the projections axially remote from said portion of said cylindrical outer surface, a flange of smaller radial height than said projections and behind which flange hook the claws of the retaining ring structure, which claws extend between said projections.

2. A commutator according to claim 1, wherein each projection has a parallelepipedic shape and each terminal terminates in a portion in the shape of a hook located in the region of a corresponding one of said projections.

3. A commutator according to claim 1, wherein each terminal defines two axially extending tabs which extend axially of the core and engage each side of a corresponding one of said projections without clearance.

4. A commutator according to claim 1, wherein the radial height of the flange is less than the thickness of the sectors and the claws are in resilient bearing relation to the tabs of said sectors.

5. A commutator according to claim 1, wherein the core is of a thermosetting plastics material.

6. A commutator according to claim 1, wherein the retaining ring structure is of a thermosetting plastics material.

* * * * *